US006264797B1

(12) United States Patent
Schroeder et al.

(10) Patent No.: US 6,264,797 B1
(45) Date of Patent: Jul. 24, 2001

(54) METHOD FOR IMPROVING LONGEVITY OF EQUIPMENT FOR OPENING LARGE, HIGH TEMPERATURE CONTAINERS

(75) Inventors: Charles Schroeder, Humble; Jinyang James Lu, Sugarland, both of TX (US)

(73) Assignee: Hahn & Clay, Houston, TX (US)

( * ) Notice: Subject to any disclaimer, the term of this patent is extended or adjusted under 35 U.S.C. 154(b) by 0 days.

(21) Appl. No.: 09/388,360

(22) Filed: Sep. 1, 1999

(51) Int. Cl.[7] ..... C10B 41/00; C10B 39/00

(52) U.S. Cl. ..... 201/39; 201/41; 202/253; 208/131

(58) Field of Search ..... 201/39, 41; 202/227, 202/253, 260; 208/131

(56) References Cited

U.S. PATENT DOCUMENTS

| | | | | |
|---|---|---|---|---|
| 3,806,032 | * | 4/1974 | Pries | 239/209 |
| 4,634,500 | * | 1/1987 | Elliott et al. | 201/39 |
| 5,622,604 | * | 4/1997 | Gerstenkorn et al. | 202/227 |
| 5,804,038 | * | 9/1998 | Nelsen | 201/39 |
| 5,891,310 | * | 4/1999 | Nelsen | 201/10 |
| 6,039,844 | * | 3/2000 | Malik | 202/227 |

* cited by examiner

*Primary Examiner*—Bekir L. Yildirim
(74) *Attorney, Agent, or Firm*—Karen B. Tripp

(57) ABSTRACT

A method is provided for cooling coke drum deheading devices, thereby extending the life of same. The method calls for spraying water or other coolant on the devices when they are in operation.

9 Claims, 1 Drawing Sheet

METHOD FOR IMPROVING LONGEVITY OF EQUIPMENT FOR OPENING LARGE, HIGH TEMPERATURE CONTAINERS

BACKGROUND OF THE INVENTION

1. Field of the Invention

The present invention relates to the opening of large vessels which operate under high temperatures and particularly to coke drums.

2. Brief Description of Relevant Art

Petroleum refining operations, in which crude oil is processed to produce gasoline, diesel fuel, lubricants and the like, always produce residues that are referred to in the industry as "coke."Coke residue, also termed "coke feedstock," is usually heated in a furnace to cause destructive distillation in which substantially all of the remaining useable hydrocarbon products are derived from the residue leaving the coke product, essentially carbon, which is conveyed into a coke drum. The typical coke drum is a large, upright, cylindrical, steel walled vessel that may, for example, be on the order of approximately 90–100 feet in height (30.48 meters) and 20–30 feet in diameter (6.10–9.14 meters), although the actual structural size and shape of the coke drum can vary considerably from one installation to another.

Typically, a refinery has a plurality of coke drums. The production of coke is usually a batch process, that is, coke feedstock is deposited into a coke drum as a liquid slurry in a very hot state—temperatures of about 900 degrees Fahrenheit (477.4 degrees Centigrade). The coke may be solid, spongy, shot or pellet-like, or even viscous liquid, depending on the quality and composition of the feedstock. When the drum is full, the feed is diverted to an empty drum and the coke filled drum is steam purged and cooled with quench water. The drum is then drained of water and the top and bottom heads of the drum are removed for removing the coke from the drum. After the coke is removed, the drum is ready to be placed back in service to repeat the cycle. While coke is being cooled in one or more drums and while the cooled coke is being extracted from one or more drums, other drums are employed to receive the continuous production of coke feedstock as a part of the refining process.

How the coke is removed from a drum varies with the type and consistency of the coke. For example, solid coke may have to be drilled out whereas shot and liquid coke may fall out when the drum bottom head is removed. Even with steam purging and cooling with quench water, however, the coke is at a high temperature, typically exceeding 200 degrees Fahrenheit, when the drum heads are opened. The drum is also under pressure. When the drum is opened, hot steam and some hot coke typically pour out with force. For safety, the drum heads are opened remotely and the drum has a head or cover assembly suited for remote operation. An example of a suitable remotely operable vessel cover particularly useful for a coke drum is described in U.S. Pat. No. 5,221,019, assigned to Hahn and Clay in Houston, Tex., and an example of a deheading or unheading device for remotely removing such a vessel cover is described in Hahn and Clay's "FACT System®" brochure.

Working in the vicinity of the bottom head of a coke drum is potentially hazardous, particularly prior to coke removal. Water and other materials can unexpectedly fall out of a drum, especially in the case of a coke cave-in. Additional methods and equipment have been introduced and proposed to further automate removal of coke from coke drums and to enhance safety measures for workers in the vicinity of the drums. Because of the high temperatures and pressures associated with the drums, such automatic equipment in proximity to the drums will also be exposed to high temperatures and pressures. Such high temperatures and pressures cause stress on the equipment and can significantly shorten their useable life. A need continues to exist for safer methods for removing high temperature materials from large industrial vessels such as coke drums.

SUMMARY OF THE INVENTION

The method of this invention is applicable to large industrial vessels whose contents are under high temperature and/or pressure. Such vessels, typically called drums, may be fitted with various equipment to facilitate the remote and/or automatic operation of the drum. For example, such a drum may be fitted with a drum head which is designed to work in cooperation with a remotely operable and automatic deheading or unheading device. Such a drum may also have associated with it equipment for automating or remotely controlling associated devices. For example, such a drum may be fitted with equipment for automatically and remotely controlling a cover over a receiver for the drum's contents so that the cover is removed from the receiver when the drum is opened so the receiver may receive the drum's contents. Because of the use of the drum, having contents at high temperatures and pressures, such related or associated equipment is also subjected to high temperatures and pressures. In the method of this invention, a coolant, preferably water, is applied directly onto such equipment. This coolant extends the life of such equipment, reducing stress and fatigue caused by the high temperatures and pressures.

In a preferred application of the invention to coke drums, a water supply to the drum is already available for the quenching process. Such water supply is further routed to spray nozzles installed near the equipment outside the drum but associated with the drum and which is equipment desired to be cooled during operation. When the equipment is in operation, the water is directed out of the spray nozzles onto the equipment.

DETAILED DESCRIPTION OF THE PREFERRED EMBODIMENT

Figure 1:
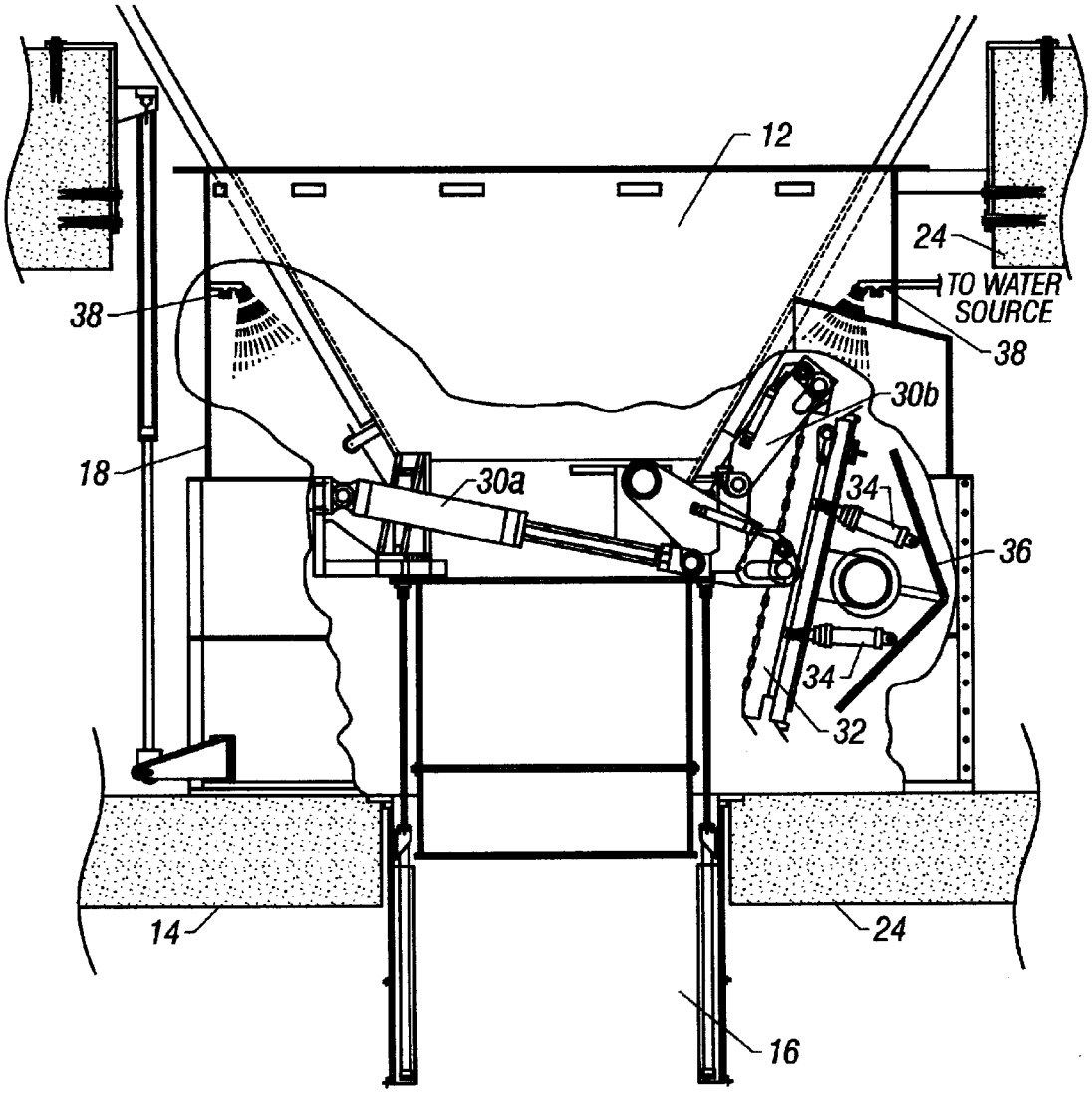
FIG. 1 shows a schematic of a delayed coker unit partially cut-away to show equipment benefitting from employment of the method of this invention.

Referring to FIG. 1, a coker or delayed coking unit used in a petroleum refinery is schematically shown. The coke drum 12 is positioned on a foundation 24 above a container 16 for receiving coke from the drum 12. Optionally, a containment curtain 18 may surround the base of the drum 12 and extend to the floor of the platform 14. The curtain 18 preferably encloses the area between the base of the drum 12 and the opening to the receiver or container 16 for receiving the coke from the drum 12. Inside the curtain 18 and positioned adjacent to the drum 12 is equipment 30*a* and 30*b* which can be operated remotely and automatically to remove the head 32 from said drum, thereby opening the drum 12 so its contents may fall or be dumped or otherwise ejected or caused to fall into the receiver or container 16. Such equipment particularly suitable for automatically deheading a drum is offered for sale by Hahn and Clay in Houston, Tex. and has been described by Hahn and Clay in its "FACT System®" brochure. A drum head or vessel cover particularly suited for deheading with such equipment is described in U.S. Pat. No. 5,221,019, assigned to Hahn and Clay in Houston, Tex. Also inside said containment curtain may be equipment 34 for lifting or otherwise removing the cover 36 to the container 16. Such equipment may operate in cooperation or conjunction with the deheading equipment 30*a* and 30*b* so the container 16, which may typically be a chute or pit, is open to receive the drum contents when the drum 12 is opened.

In the method of this invention, spray nozzles 38 are positioned near such equipment 30*a* and 30*b* and 34. A supply of coolant for the equipment 30*a* and 30*b* and 34 is provided to the nozzles. Such coolant may be water routed from the same source used for quenching the coke in the drum or may be water or other coolant provided from another source. In any case, the coolant is provided such that it is available and sprays from the nozzles when the equipment 30*a* and 30*b* and 34 is in operation. The spray may be turned on and off by separate controls or may be tied into the controls for the equipment 30*a* and 30*b* and 34. The amount of water or other coolant should preferably be sufficient to fully cover the equipment and should preferably be ejected from the spray nozzles with sufficient force to efficiently reach the equipment and cover it at least substantially and preferably for the duration of the operation of the equipment. The water or other coolant may optionally be applied to the equipment at other times as well.

In FIG. 1, spray nozzles 38 are positioned, or attached to, or supported by the curtain 18. Alternatively, the nozzles 38 may be positioned, or attached to, or supported by the foundation 24 or by pipes or other supports attached to the foundation, by the drum 12, or even by the equipment to be sprayed with the nozzles, such as for example equipment 30*a* or 30*b* or 34.

Although the present invention and its advantages have been described, it should be understood that various changes, substitutions and alterations can be made without departing from the spirit and scope of the invention as defined by the following claims.

We claim:

1. In a coker unit of a petroleum refining process, wherein a drum is positioned above a container for receiving coke from said drum, a method for improving the longevity of equipment associated with automating the operation of said drum or the removal of coke from said drum, comprising:

installing spray nozzles directed toward said equipment;

providing a source for water or other coolant to said spray nozzles; and causing said coolant to flow from said source out of said spray nozzles onto said equipment when said equipment is operating.

2. The method of claim 1 further comprising a containment curtain positioned around the base of said drum and extending to said container, wherein said containment curtain provides support for said spray nozzles.

3. The method of claim 1 wherein said spray nozzles are attached to the foundation walls of said coker unit adjacent said drum.

4. The method of claim 1 wherein said spray nozzles are attached to the drum.

5. The method of claim 1 wherein said spray nozzles are attached to said equipment.

6. The method of claim 1 wherein said equipment is for opening and closing, or removing and replacing, the drum head at the base of said drum.

7. The method of claim 1 wherein said equipment is for lifting and removing a cover over the receiver for said coke underlying said drum.

8. A method for cooling equipment associated with automating the operation of a large industrial vessel containing materials at high temperatures comprising spraying water or other coolant on said equipment while said equipment is in operation.

9. The method of claim 8 wherein said operation is the opening of said vessel.

* * * * *